US005495808A

United States Patent [19]

Wegrecki

[11] Patent Number: 5,495,808

[45] Date of Patent: Mar. 5, 1996

[54] CEILING MOUNTING BRACKET FOR A MINE TUNNEL

[76] Inventor: Stanislaw F. Wegrecki, 510 Allison Ave., Washington, Pa. 15301

[21] Appl. No.: 181,039

[22] Filed: Jan. 14, 1994

[51] Int. Cl.[6] ..... E01B 25/22

[52] U.S. Cl. ..... 104/111; 248/323

[58] Field of Search ..... 104/89, 91, 93, 104/94, 95, 111, 115; 248/323, 324; 16/87 R, 90, 94 R

[56] References Cited

U.S. PATENT DOCUMENTS

| | | | |
|---|---|---|---|
| 623,035 | 4/1899 | Richards | 16/94 R |
| 4,116,134 | 9/1978 | Troth | 104/111 |

FOREIGN PATENT DOCUMENTS

| | | | |
|---|---|---|---|
| 3245513 | 6/1984 | Germany | 104/111 |

*Primary Examiner*—Robert J. Oberleitner
*Assistant Examiner*—Kevin D. Rutherford
*Attorney, Agent, or Firm*—George C. Atwell

[57] ABSTRACT

The invention comprises a ceiling mounting bracket for securement to a mine tunnel ceiling and which is used for suspending a monorail therefrom; a mobile advancing conveyor system is, in turn, suspended from the monorail and used to facilitate removal of ore from the mine tunnel. The ceiling mounting bracket includes a flat mounting plate disposed contiguous to the mine ceiling, a longitudinal slot formed on the mounting plate and which is parallel to the monorail when the monorail is pendent from the ceiling mounting bracket, and a pair of opposed lateral slots perpendicular to the longitudinal slot for permitting lateral adjustment and positioning of the ceiling mounting bracket prior to securement to the mine ceiling. A ceiling bracket bar is disposed subjacent to the ceiling mounting plate and is capable of slidable, longitudinal, reciprocable movement parallel to the slot. Attached to and suspended from the ceiling bracket bar is a rail hanger which moves in conjunction with the bar and to which one end of an individual segment of the monorail is mounted. In order to compensate for mine tunnel ceiling undulation, a plurality of rail hanger extensions, each a different length, can be interposed between, and attached to, the ceiling bracket bar and the rail hanger.

11 Claims, 6 Drawing Sheets

FIG. 2
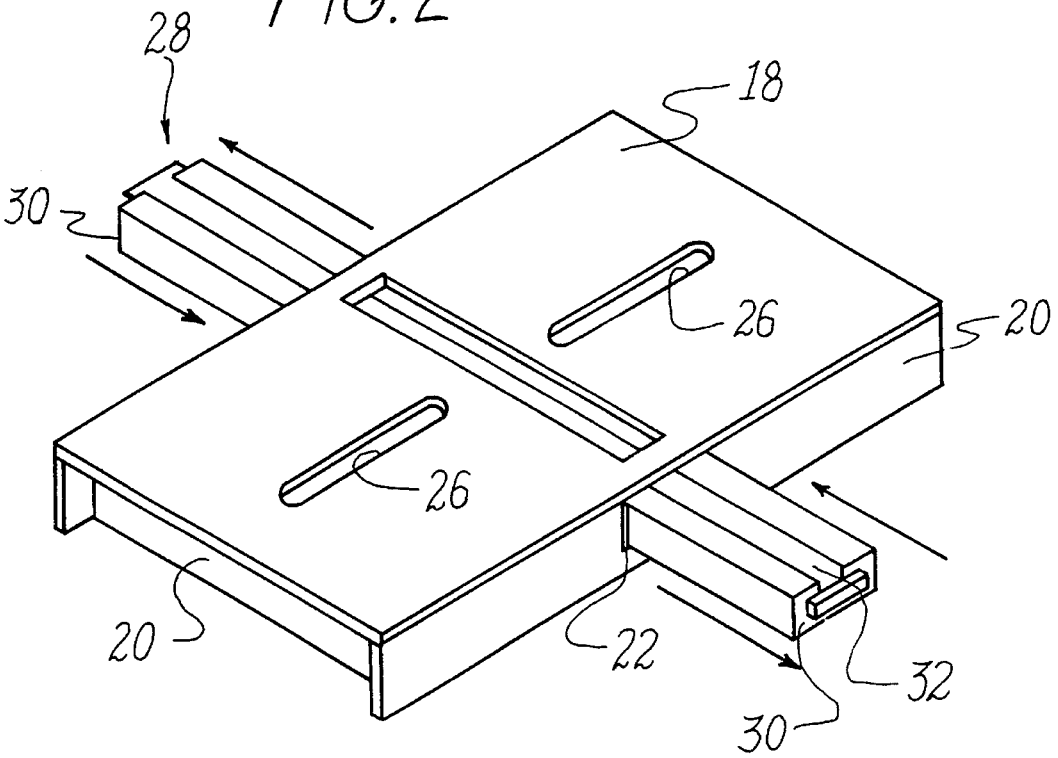
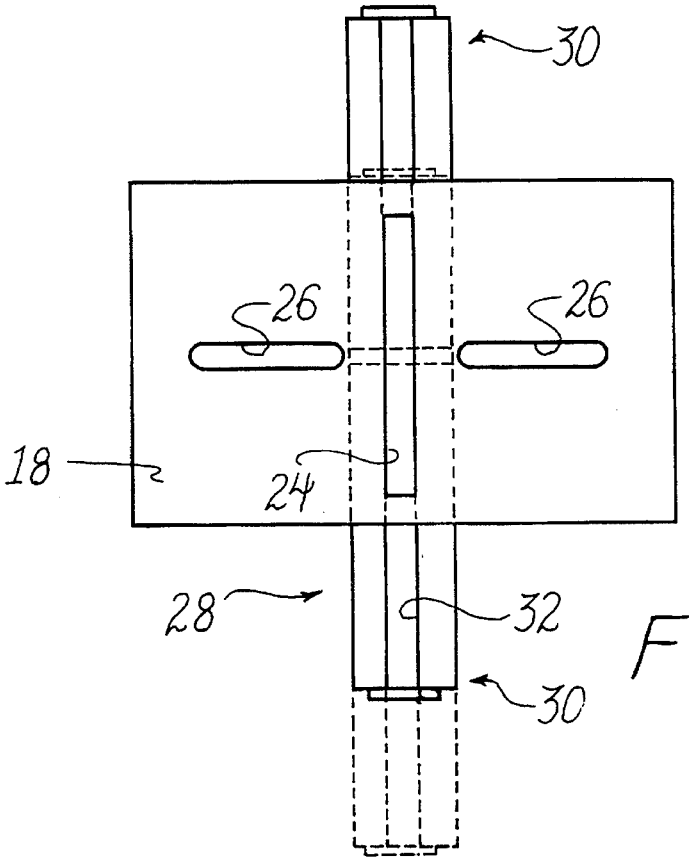
FIG. 3

CEILING MOUNTING BRACKET FOR A MINE TUNNEL

BACKGROUND OF THE INVENTION

The present invention relates to devices for suspending structural elements from an overhead surface, and more particularly pertains to a device for suspending a rail from an overhead surface, such as the ceiling of a mine tunnel.

After one or a number of mine tunnels, which may vary widely in length, have been constructed into and through a seam or strata of ore-bearing rock or earth, various machines and devices must be employed to dig and remove the ore from the mine tunnel. Because of the chemical composition, location (surface versus subsurface), and difficulty of extraction for each particular ore, specialized devices and machinery have been developed for mining the numerous ores essential for contemporary industrial manufacturing processes and techniques. In addition to the above factors, a mining operation must also consider: 1) whether the ore to be mined is located in a self-supporting geologic structure or whether the geologic structure requires man-made mechanical supporting; 2) whether the ore to be mined is of a powdering or non-powdering variety; 3) whether the mining of the ore creates a gassy or non-gassy condition within the mine tunnel; and 4) the height and width of the mine tunnel. Mine tunnel ceilings can be as low as four feet while the width of coal mine tunnels varies from fourteen to twenty feet (sixteen feet being the average width), and potash mine tunnels have self-supporting ceilings and widths of between thirty-five to forty feet.

Thus, the specialized long wall technology for mining anthracite coal, for example, will differ from the specialized technology employed in mining potash, which is a salt-like substance and a self-supporting geologic structure for mining purposes. Potash is a non-powdering mineral and a potash mine is non-gassy. Moreover, because potash is a self-supporting geologic structure, no ceiling structure is required. The contrast between the conditions involved in potash mining as opposed to coal mining is given to illustrate how the mining of each kind of ore is a unique endeavor necessitating special considerations and specialized technology.

In the mining of an ore which is a self-supporting geologic structure (i.e., potash), a continuous conveyor system is frequently utilized to continuously transport ore out of the mine. A continuous conveyor system typically includes a continuous conveyor belt, some type of truss assembly for supporting the continuous conveyor belt, a monorail which defines the path of travel for the conveyor belt and truss assembly and from which both the belt and the truss assembly are suspended, and a means to suspend the monorail—and, as a consequence, also the conveyor belt and the truss assembly—from the overhead mine ceiling. The monorail itself comes in standard eight-foot segments which can be added or removed as needed in order to suspend the conveyor system therefrom.

U.S. Pat. No. 4,896,764 discloses one example of an apparatus for carrying, advancing, and retracting a conveyor in a mine to remove ore from the mine, and also teaches the use of ceiling bolts to suspend the monorail from the mine tunnel ceiling. This manner of suspending the monorail does not allow for any kind of adjustment in the suspended distance of the monorail from the ceiling once the bolts are inserted into the mine ceiling, nor does it allow vertical adjustability of the ceiling bolts which would compensate for the undulation of the mine ceiling so that the generally level suspension of the monorail can be attained. The monorail must be suspended in a generally parallel, elongate line, and this type of suspension must be achieved despite the fact that few, if any, mine ceilings will be perfectly even. Thus, a system or device which allows for selective adjustability thereof to compensate for mine ceiling undulation yet maintains suspension of the monorail in a generally parallel, elongate line from the ceiling is an advantageous enhancement for any conveyor system.

SUMMARY OF THE INVENTION

The apparatus of the present invention comprehends a ceiling mounting bracket and a belt car which are parts of a mobile advancing conveyor ("MAC") system used in mining operations. The ceiling mounting bracket is secured to an overhead surface, such as a mine tunnel ceiling, for suspending a plurality of monorail segments, comprising a monorail, from the overhead surface. In turn, suspended from the monorail are a plurality of belt car hangers (the truss supports and idler assemblies) and belt cars which are the primary structural elements comprising the MAC system. The MAC system is used to remove ore from the mine and can be advanced or retracted within the mine tunnel as part of the mining operation. The MAC system includes a plurality of standard belt cars disposed in an end-to-end elongate line within the mine tunnel or tunnels. Interposed between each belt car is a belt car hanger, and each belt car is capable of removable securement to the belt car hangers.

The ceiling mounting bracket of the present invention is secured to the overhead surface, and when the ceiling mounting bracket is used in a mining operation environment, it is secured to the mine tunnel ceiling. The ceiling mounting bracket has a box-like shape and includes a flat mounting plate which is disposed contiguous to the mine ceiling. The mounting plate further includes a longitudinal slot which extends substantially the length of the mounting plate and is parallel with the monorail when the monorail is suspended from the ceiling by the ceiling mounting bracket.

In order to laterally adjust or shift the ceiling mounting bracket toward each sidewall of the mine tunnel to better position the monorail for suspension therefrom, the ceiling mounting bracket includes an integral lateral adjustment means. The lateral adjustment means comprises a pair of opposed lateral adjustment slots formed on the mounting plate that are parallel to one another but perpendicular to the longitudinal slot. Thus, while the slot of the ceiling mounting bracket is generally parallel to the monorail, the lateral adjustment slots would be transverse to the monorail.

Depending from at least two opposed edges or sides of the mounting plate are sidewalls, each defining a centrally located aperture, and the aperture of one sidewall is in axial alignment with the aperture of the opposite sidewall. Each monorail segment has specially designed ends for removable mounting to one rail hanger which would be pendent from the ceiling mounting plate. More specifically, the rail hanger is attached to and suspended from a ceiling bracket bar which is inserted through the apertures of the sidewalls subjacent to the mounting plate. The ceiling bracket bar is capable of slidable, reciprocable, longitudinal movement beneath and parallel to the slot for positioning the rail hanger, and the rail hanger is fixed to the central portion of the ceiling bracket bar. The ceiling bracket bar is longer than the mounting plate, and a substantial portion of the ceiling bracket bar can project through either respective aperture and past either respective sidewall when the bar is moved for positioning the rail hanger and attaining proper suspension of the monorail. The ceiling bracket bar cannot be slid completely through the apertures because the rail hanger is centrally fixed to the ceiling bracket bar and the limit of slidable reciprocable movement of the ceiling bracket bar is reached when the rail hanger abuts the inside surface of either sidewall. Moreover, greater loads can be suspended from the ceiling mounting bracket because the ceiling bracket bar is supported at both of its ends by the sidewalls.

In addition, the ceiling mounting bracket includes a plurality of rail hanger extensions; each rail hanger extension comes in a different length. The rail hanger extensions are interposed between, and attached to, the ceiling bracket bar and the rail hanger to compensate for undulations in the mine ceiling so that the generally level suspension of the monorail from the ceiling can be achieved. Since the rail hangers do not come in different lengths and the height of the mine ceiling can vary throughout the length of the mine tunnel, rail hanger extensions are used to compensate for mine ceiling undulation.

It is an objective of the present invention to provide a ceiling mounting bracket which is capable of lateral adjustment during positioning and securing to an overhead surface, such as a mine tunnel ceiling.

It is a further objective of the present invention that the lateral adjustment means is integral with the ceiling mounting bracket for ease and simplicity of positioning so that each monorail segment can be suspended from the mine ceiling in a generally level disposition throughout the entire length of the monorail.

Yet another objective of the present invention is to provide a ceiling mounting bracket having a compact shape and design to enable its utilization in mine tunnels having ceiling heights as low as four feet.

The foregoing and other objects and advantages, when taken in conjunction with the following detailed description and accompanying drawings, illustrate the preferred embodiment of the invention.

BRIEF DESCRIPTION OF THE DRAWINGS

FIG. 2 is an enlarged isometric view of the mounting plate and the ceiling bracket bar of the ceiling mounting bracket first shown in FIG. 1;

FIG. 3 is a top plan view of the mounting plate and ceiling bracket bar illustrating the longitudinal movement of the ceiling bracket bar first shown in FIG. 2;

DETAILED DESCRIPTION OF THE PREFERRED EMBODIMENT

Illustrated in FIGS. 1–8 and 10 is a ceiling mounting bracket 10 which can be removably secured to an overhead surface, such as the ceiling of a mine tunnel. The bracket 10 is specially designed for mine tunnels that do not require any sort of ceiling structure or framework to support the mine tunnel. One well-known self-supporting geologic structure is potash which is used in the manufacture of fertilizers for agriculture and in many chemical processes and for various industrial uses. Potash is a potassium compound and, in its natural state, is a salt-like substance. Furthermore, a potash mine is a non-gassy mine. On the other hand, coal mines are not self-supporting geologic structures, and a coal mine, obviously, is a gassy mine. Because the ceiling of a potash mine tunnel is self-supporting, potash mine tunnels can often be up to thirty-five to forty feet wide. There is a certain amount of undulation in the potash mine ceiling and the bracket 10 is designed to accommodate and compensate for this undulation.

Figures 4, 5:
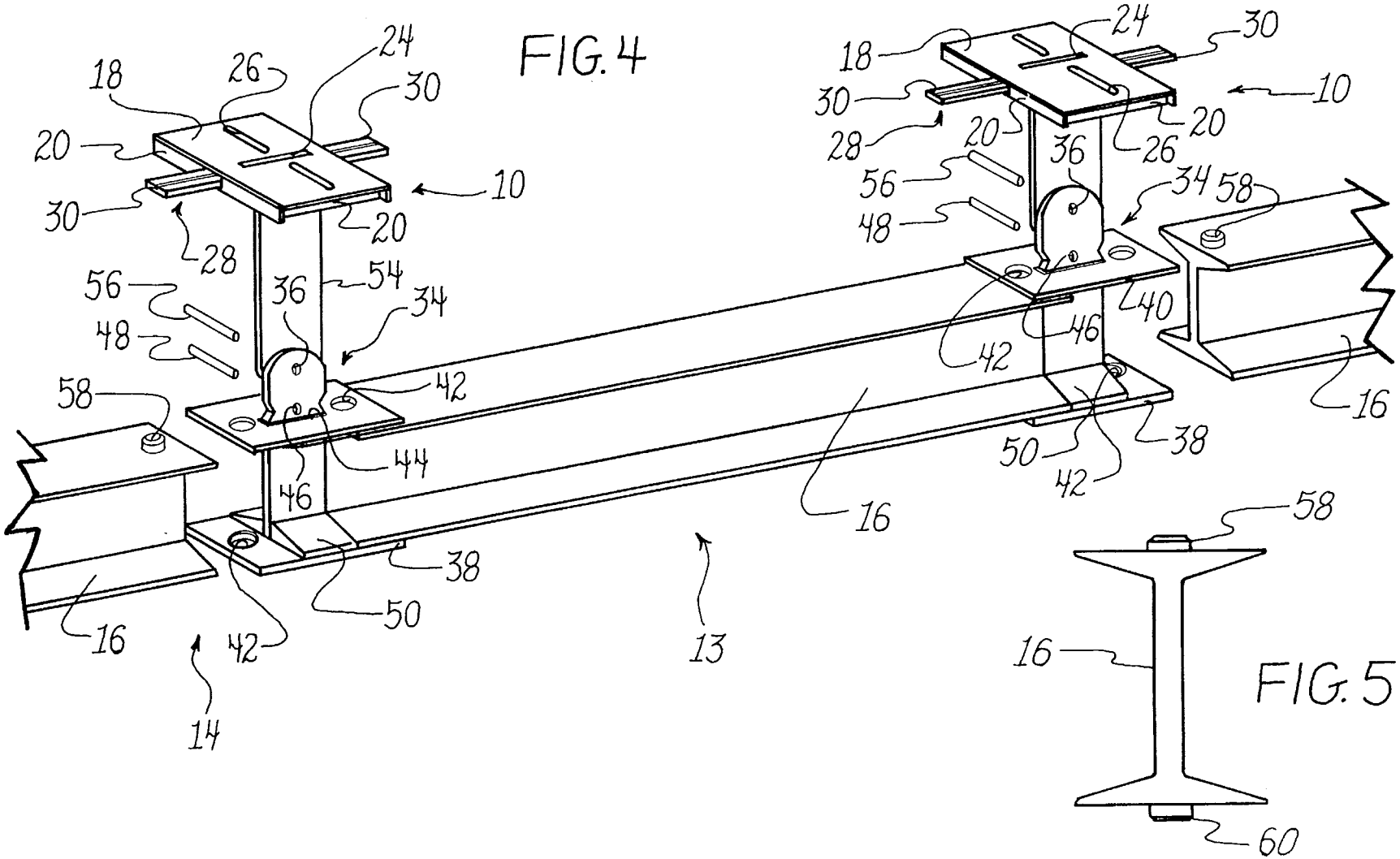
FIG. 4 is an isometric view of two ceiling mounting plates in their operative disposition of suspending a rail from a mine ceiling.
FIG. 5 is an elevational view of a rail end first shown in FIG. 4.
Figure 7:
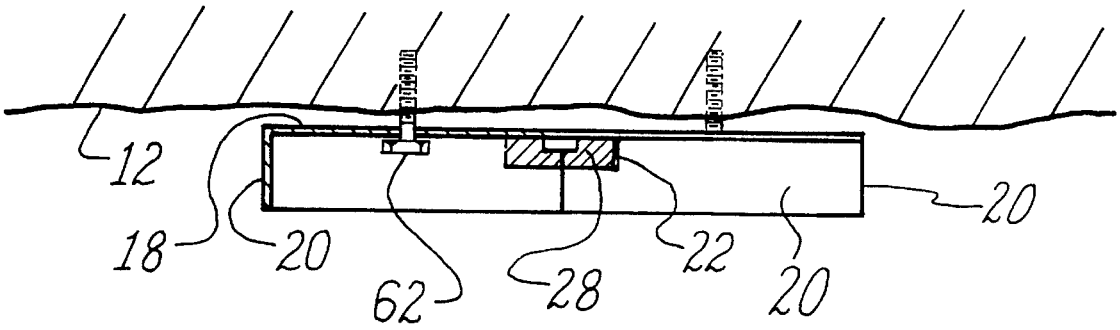
FIG. 7 is a sectioned elevational view of the ceiling mounting plate taken along lines A—A of FIG. 6.
Figure 8:
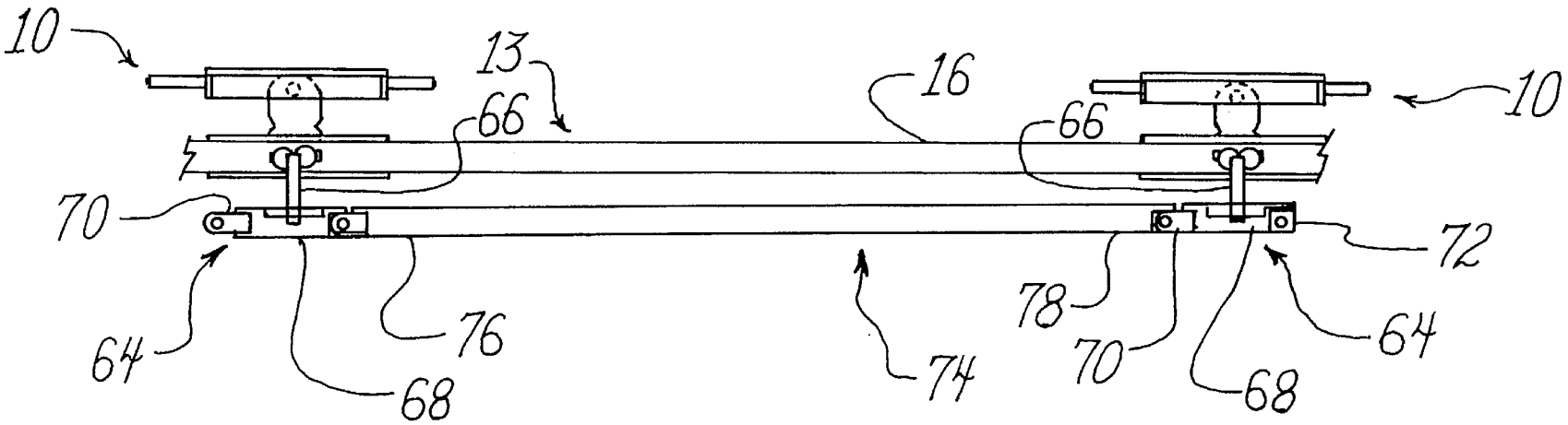
FIG. 8 is a side elevational view of two belt car assemblies operatively disposed to support a belt car.
Figure 9:
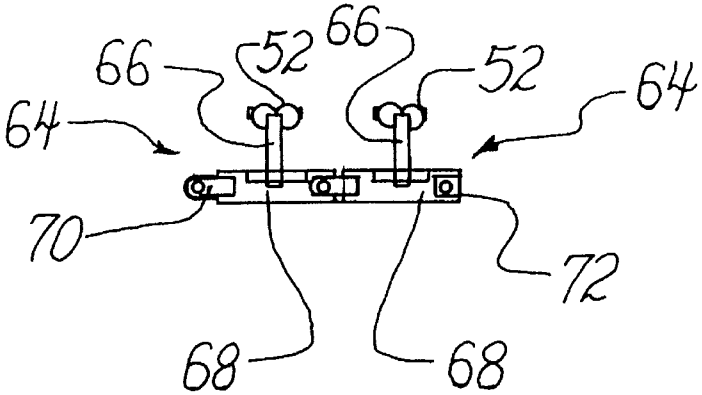
FIG. 9 is a side elevational view showing the two belt car assemblies of FIG. 8 attached to each other.

The bracket 10 is used to suspend continuous haulage equipment from a ceiling 12, which may be a mobile advancing conveying ("MAC") system 13, broadly designated in FIGS. 4, 8, and 9. The MAC system 13 is suspended from the ceiling 12 and extends throughout the mine tunnel or tunnels which are being worked. FIGS. 4, 8, 9, and 10 illustrate portions of the MAC system 13 and also show some of the structural elements which make up the Mac system 13. Suspended immediately from the bracket 10 is an elongated rail 14, commonly called a monorail, which extends throughout the mine tunnel or tunnels. The monorail 14 commonly used in potash mines comes in eight-foot segments 16 which are successively suspended end-to-end by the brackets 10.

This requires that a plurality of brackets 10 be mounted to the ceiling 12 throughout the length of the mine tunnel. As will be described hereinafter, the brackets 10 are box-bolted to the ceiling 12 and the monorail segments 16 are center-loaded from the brackets 10 for suspension therefrom.

Figure 1:
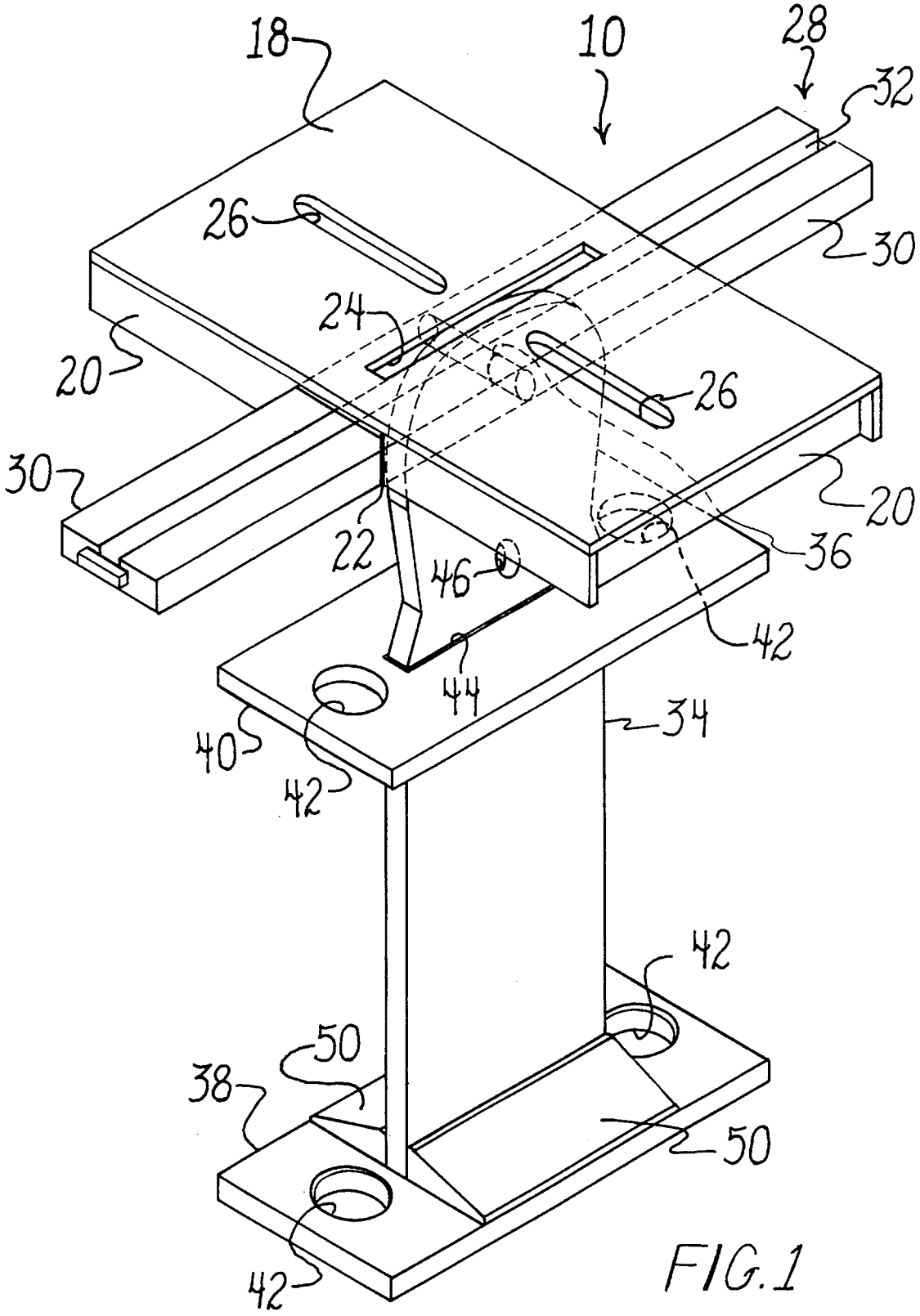
FIG. 1 is an isometric view of a ceiling mounting bracket in accordance with the present invention.

Illustrated in FIGS. 1–4, 6–7, and 10 is a flat mounting plate 18 of the bracket 10. The plate 18 is disposed contiguous to the ceiling 12 for securement thereto; although in FIG. 7 a slight clearance is shown between the plate 18 and the ceiling 12, this clearance would be eliminated by contiguous securement of the plate 18. The plate 18 includes a ceiling bracket bar retaining means and, in the preferred embodiment of the invention, the retaining means includes at least one pair of opposed sidewalls fixed to and depending from the plate 18. The bracket 10 includes four sidewalls 20 secured to the plate 18 and projecting downwardly therefrom a slight distance when the bracket 10 is secured to the ceiling 12. As shown in FIGS. 1, 2, and 4, at least one pair of the opposed sidewalls 20 includes a centrally located aperture 22, and the aperture 22 of one sidewall 20 is axially aligned with the aperture 22 of the opposed sidewall 20.

The bracket 10 includes several features to facilitate the proper securement and positioning of the monorail segments 16 from the bracket 10 so that the successively suspended segments 16 are spaced parallel to one another and generally the same distance from the ceiling 12. As shown in FIGS.

1–4 and 6, the plate 18 includes a longitudinal slot 24 formed thereon and extending substantially the length thereof. The slots 24 would be parallel to the pendent monorail segments 16 in a MAC system 13 fully assembled within the mine tunnel. The bracket 10 also includes a lateral adjustment means integral to the bracket 10 for allowing selective, lateral positioning of the plate 18 against the ceiling 12. Normally, all of the required brackets 10 are secured to the ceiling 12, then the lateral adjustment means is utilized to properly align the brackets 10 within the tunnel. As shall be fully described hereinafter, proper alignment of the brackets 10 is done before the segments 16 are suspended therefrom. The lateral adjustment means includes a pair of opposed lateral adjustment slots 26 integrally formed on the plate 18 and which are spaced from each other and disposed perpendicular to the slot 24. The slots 26 of the bracket 10 are transverse to the elongated extension of the rail segments 16 when the brackets 10 are secured to the ceiling 12. The slots 26 permit lateral adjustment of the bracket 10 before it is tightly secured to the ceiling 12.

Figure 6:
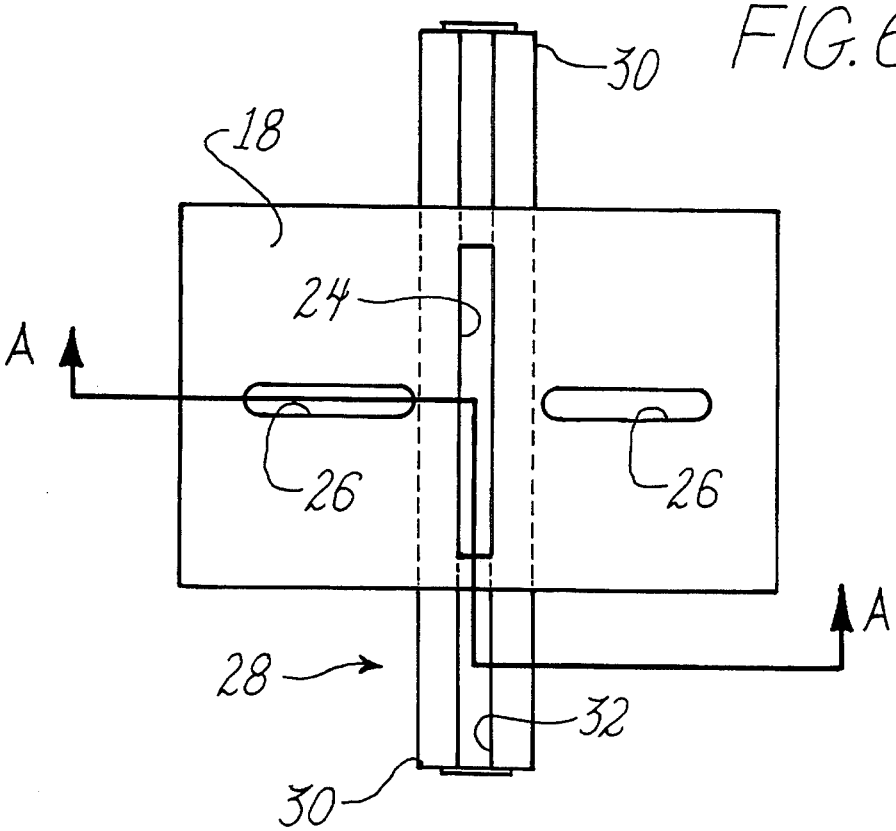
FIG. 6 is a top plan view of the ceiling mounting plate and ceiling, bracket bar first shown in FIG. 3.

As shown in FIGS. 1, 4, and 6, the bracket 10 includes an elongated ceiling bracket bar 28 which is disposed immediately subjacent to the plate 18 and capable of slidable, reciprocable, longitudinal movement parallel with the slot 24 as part of the process of properly positioning each rail segment 16 for suspension from the bracket 10. The bar 28 has a length greater than the width of the plate 18, as clearly illustrated in FIGS. 1–4 and 6, so that the bar 28 can extend through and past each aperture 22 of each respective sidewall 20, and, thus, the bar 28 is supported by its extension through the apertures 22 of the sidewalls 20. The slidable longitudinal movement of the bar 28 also facilitates the proper positioning and securement of rail segments 16 to the brackets 10 and, as shown in FIG. 3, a substantial portion of either end 30 of the bar 28 can project past the respective sidewall 20 as a result of the longitudinal movement of the bar 28. The restriction or limitation of movement of the bar 28 will be hereinafter fully discussed. The bar 28 itself is actually two elongated steel or iron bars spaced a slight distance from each other and which define an elongated bar slot 32, and the elongated bars are held together by tie bars welded to the ends 30 of the bar 28. As shown in FIGS. 3 and 6, the slot 32 extends the full length of the bar 28.

Illustrated in FIGS. 1 and 4 is a rail hanger 34 mounted to the bar 28 so that the hanger 34 is pendent therefrom. The hanger 34 is actually inserted in the space defined by the slot 32 and is mounted at the mid-section or central point of the bar 28. Each individual bar comprising the bar 28 includes a circular slot (not shown) and the circular slots are in axial alignment when the bar 28 is fully assembled. The hanger 34 also includes a circular slot 36, and when the hanger 34 is pendently mounted to the bar 28, the upper rounded portion of the hanger 34 is inserted in the slot 32 so that the circular slots of the bar 28 align with slot 36, and then a roll pin (not shown) is inserted through all the slots to pin the hanger 34 to the bar 28. Thus, once the hanger 34 is pinned to the bar 28, the hanger 34 will move in conjunction with the longitudinal movement of the bar 28 during positioning of the bracket 10 for properly suspending the rail segments 16 from the ceiling 12.

As shown in FIGS. 1 and 4 the hanger 34 includes a flat bottom plate 38 and a flat top plate 40, and when the hanger 34 is disposed in its operative position, the top plate 40 is spaced from and above the bottom plate 38. Both plates 38 and 40 extend perpendicular to the hanger 34 when the hanger 34 is pendently mounted to the bar 28. Each plate 38 and 40 includes a pair of spaced-apart dowel receiving apertures 42 located adjacent the edge of each short side of each plate 38 and 40. The top plate 40 also includes an elongated slot 44 located between the apertures 42 and through which the upper rounded portion of the hanger 34 projects. The hanger 34 also includes a second roll pin aperture 46 located beneath the slot 36 and through which a roll pin 48 is inserted. The insertion of this pin 48 through the aperture 46 prevents the plate 40 from being lifted up on the hanger 34 when the hanger 34 is disposed in its operative position. The plate 38 is permanently secured to the bottom of the hanger 34, preferably by being welded thereon. Mounted to the plate 38 and the lowest portion of the hanger 34 are a pair of opposed flanges 50, which may be referred to as S-beam flanges, which provide a continuous surface for dolly wheels 52 of the MAC system 13 to ride upon. FIG. 4 most clearly illustrates how the addition of the flanges 50 provides a continuous surface for the wheels 52 to ride upon as the wheels 52 roll on one rail segment 16 to the next rail segment 16. Without the flanges 50, the wheels 52 of the MAC system 13 would drop off into a slight depression as the wheels 52 roll across one rail segment 16 to the next adjoining rail segment 16. The wheels 52 would quite likely get caught in this slight depression formed between the ends of two adjoining rail segments 16 attached to the hanger 34 and this would quite likely damage operation of the conveyor belt of the MAC system 13 as the belt was being extended or retracted within the mine tunnel.

FIGS. 2 and 3 illustrate the manner of longitudinal movement of the bar 28 with respect to its subjacent disposition to the plate 18, and FIG. 1 illustrates the mounting of the hanger 34 to the bar 28. The longitudinal movement of the bar 28 is constrained by the upper rounded portion of the hanger 34. When the upper rounded portion of the hanger 34 contacts either inside surface of either sidewall 20 then the limit of longitudinal movement of the bar 28 in that particular direction has been reached. By mounting the hanger 34 at the center of the bar 28, the maximum amount of longitudinal movement of the bar 28 in either direction is achieved. In addition, this provides a more secure and stable center loading of the rail segment ends from the bracket 10 when adjoining rail segments 16 are mounted to the hanger 34.

As shown in FIG. 4, the bracket 10 also includes a plurality of rail hanger extensions 54 which are utilized to compensate for mine ceiling undulation. Each extension 54 is an elongated structural piece having an upper extension end for attachment to the bar 28 and a lower extension end for attachment to the hanger 34. Located at the upper extension end is an extension slot (not shown) and located at the lower extension is an extension aperture (not shown). In order to utilize the extensions 54, the upper extension end of the extension 54 is inserted into the space defined by the slot 32 then a dowel pin (not shown) is inserted through the slots of the bar 28 and the aperture at the upper extension end of the extension 54, thus pinning the extension 54 to the bar 28. The aperture at the lower end of the extension 54 is aligned with the aperture 36 located at the upper rounded portion of the hanger 34 and a roll pin 56 is inserted therethrough for pinning the hanger 34 to the extension 54. As shown in FIG. 4, the extensions 54 come in different lengths so that the rail segments 16 can be suspended at greater distances from the plate 18 and the ceiling 12 to ultimately provide a level suspension of the monorail 14 from the ceiling 12 throughout extension of the monorail 14 in the mine tunnel. The rail segment ends or joints can vary slightly up or down within approximately 5° while still permitting the unhindered movement of the wheels 52 upon the rail segments 16. It is generally not necessary to interpose more than one extension 54 between the bar 28 and the hanger 34.

As shown in FIGS. 4 and 5, each opposed rail segment end includes an upper and a lower nub or dowel 58 and 60 mounted thereto. In order to attach the bracket 10 to the ceiling 12, and to then attach successive rail segments 16 to create a monorail 14 for extension through the tunnel, the following steps are required. First, the bracket 10 is bolted with a pair of specially designed bolts 62 to the ceiling 12. Next, the bar 28 is slid into one aperture 22. The upper rounded portion of the hanger 34 is inserted into the slot 32 so that the upper aperture 36 is aligned with the circular slots of the bar 28, and then a roll pin is inserted through all three apertures to pin the hanger 34 to the bar 28. This secures the hanger 34 pendent to the bar 28. The top plate 40 has previously been slid onto the hanger 34 by inserting the upper rounded portion of the hanger 34 through the slot 44. The top plate 40 will be slid completely down on the hanger 34 so that it rests upon the flanges 50 and the bottom plate 38.

The brackets 10 are bolted to the center line of the MAC system 13 in the mine tunnel, and the number of brackets 10 used is dependent upon the length of the MAC system 13 and the length of the mine tunnel. If a rail track (not shown), which is another part of the MAC system 13, is mounted to the mine tunnel entrance, the brackets 10 may be mounted in an offset position relative to the center line of the mine tunnel. Because the bolts 62 allow partial mounting of the brackets 10 into the ceiling 12, alignment of the brackets 10 by using the slots 26 for laterally adjusting the brackets 10 relative to the center line or moving the bar 28 in a longitudinal manner relative to the slot 18 of the bracket 10 can now occur. The lateral adjustment of the brackets 10 may vary from bracket 10 to bracket 10 and the longitudinal positioning of each respective bar 28 may also vary in order to achieve the level suspension of the rail segments 16 from the ceiling 12.

The top plate 40 is then lifted up and, using forklifts or other mechanical devices, an individual rail segment 16 is positioned so that the lower dowel 60 is fitted into the one aperture 42. Also, the lower dowel 60 of the next adjoining and successive rail segment 16 is also lowered into the other aperture 42 on that same bottom plate 38. Thus, at this point, the bottom dowels 60 of two adjacent rail segments 16 have been fitted into the apertures 42 of the bottom plate 38 of one hanger 34. The rail segments 16 are then brought into a level position and then the top plate 40 is slipped down over the upper dowels 58 so that the upper dowels 58 on each rail segment end fit into the apertures 42 of the top plate 40. The roll pin 48 is then inserted into the aperture 46 to prevent the top plate 40 from being lifted up off of the adjacent rail segment ends of the two successively mounted rail segments 16. Two rail segments 16 have now been attached to one bracket 10 and are allowed to slightly sag before being attached to the next adjacent in-line hangers 34. Normally, the plates 18 are first mounted to the ceiling 12, and then the bars 28 and rail segments 16 are suspended one after another from the brackets 10.

Figure 10:
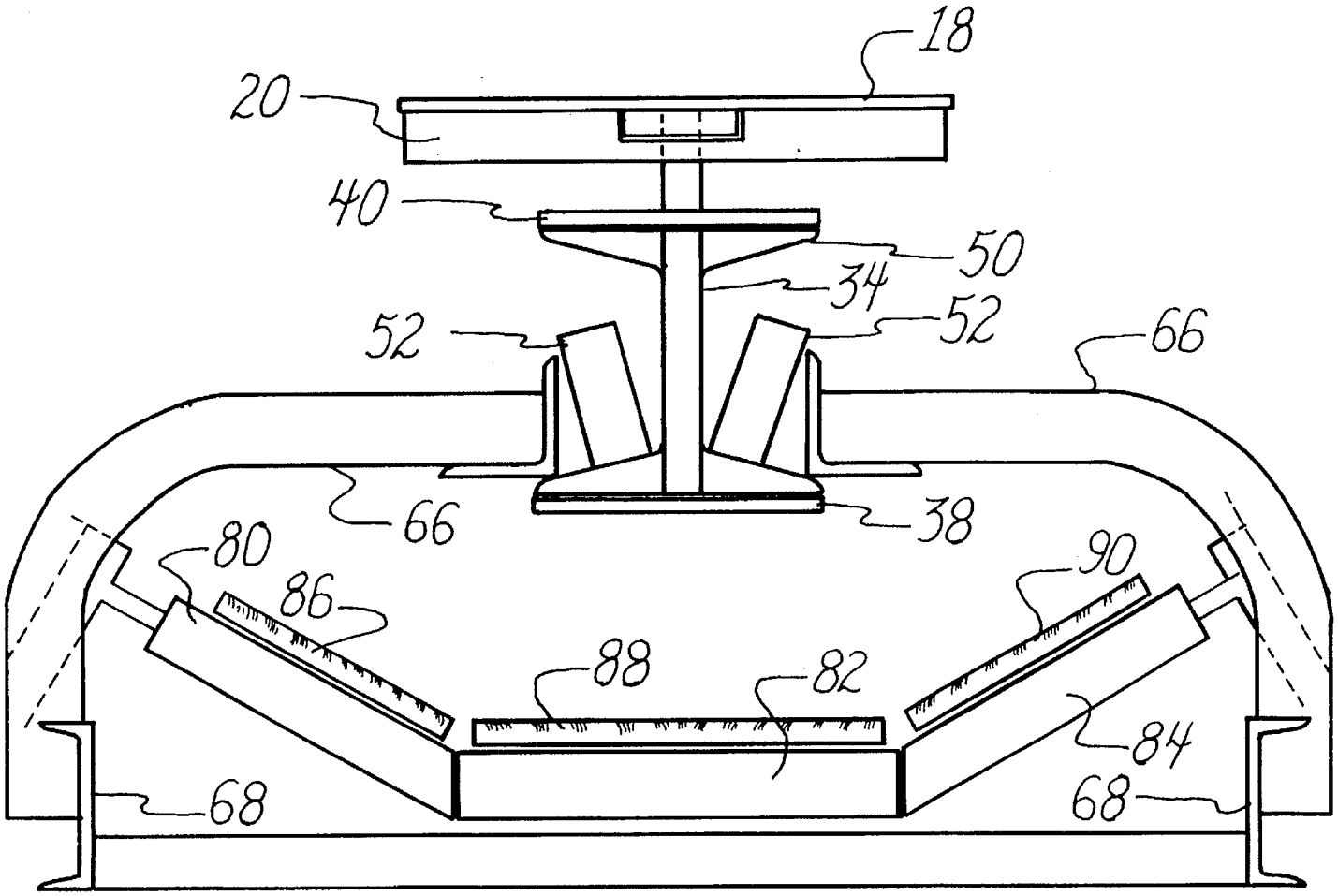
FIG. 10 is a longitudinal elevational view showing a ceiling mounting bracket and the belt car assemblies supporting a conveyor system for disposition and use in a mine tunnel.

As shown in FIGS. 8–10, a belt car hanger 64 is suspended from the monorail 14 and is also part of the MAC system 13. The hanger 64 is suspended from the monorail 14 and is movable thereon by means of wheels 52 which roll along the monorail 14. The MAC system 13 as shown in FIGS. 8 and 9 includes a plurality of hangers 64 which are mounted to the monorail 14 and are pendently attached to truss supports 66. The hangers 64 are capable of reciprocal, longitudinal movement along the monorail 14. Each hanger 64 further includes two main body members 68, a pair of spaced-apart hanger pin members 70 with one member 70 on each side of the conveyor belt and attached to and projecting forward of each respective member 68, and a pair of spaced-apart rear hanger pin receiving portions 72, with one portion 72 integral with each respective member 68. The hangers 64 are preferably manufactured from angle iron members, square tubing, and iron channel members. It should be noted that the supports 66 and members 68 disposed on either side of the belt to support the belt are identical in structure.

Interposed between a pair of hangers 64 is an elongated belt car 74; in typical MAC systems 13 a plurality of cars 74 must be used to extend the MAC system 13 throughout the mine tunnel. The cars 74 are removably attachable to the hangers 64 and are disposed within the mine tunnel, end-to-end, parallel with the extension of the monorail 14 for supporting the belt. The cars 74 may be formed from channel-iron members, and each car 74 includes an arbitrarily designated front end 76 and rear end 78. The cars 74 are successively aligned end-to-end within the tunnel and suspended from the monorail 14 by the hangers 64 so that the front end 76 is removably attachable to the respective portions 72 of one hanger 64 while the rear end 78 of that car 74 is removably attachable to the members 70 of the following hanger 64. Because each car 74 is removably attachable to the hangers 64 by being pinned thereto, the MAC system 13 can be shortened or lengthened by simply removing or adding cars 74 to the MAC system 13, as required by the mining operation.

FIG. 9 illustrates the disposition of one pair of hangers 64 wherein the interposed car 74 has been removed so that the members 70 are secured to the portions 72 of the adjacent hanger 64. The use of cars 74 which are removably attachable to the hangers 64 provides greater flexibility for the MAC system 13 to adapt to a wide variety of mining operations. FIG. 10 shows a typical disposition of rollers 80, 82, and 84, and conveyor belts 86, 88, and 90 in a MAC system 13.

In the drawings and specification, there have been disclosed typical preferred embodiments of the invention and, although specific terms are employed, they are used in a generic and descriptive sense only and not for purposes of limitation, the scope of the invention being set forth in the following claims.

I claim:

1. A ceiling mounting bracket for suspending successive segments of rail from a mine tunnel ceiling, comprising:

a flat mounting plate for securement contiguous to the mine tunnel ceiling;

the mounting plate having a longitudinal slot which extends substantially the length of the mounting plate;

lateral adjustment means integral to the ceiling mounting bracket for allowing selective lateral positioning of the mounting plate against the mine tunnel ceiling;

an elongated ceiling bracket bar supported by and disposed subjacent to the mounting plate and capable of slidable, reciprocable, longitudinal movement parallel with the slot for positioning the rail beneath the mine tunnel ceiling; and a rail hanger mounted to the ceiling bracket bar so that the rail hanger is pendent from the ceiling bracket bar, the rail hanger moving longitudinally in conjunction with the movement of the ceiling bracket bar beneath the mine tunnel ceiling.

2. The ceiling mounting bracket of claim 1 wherein the rail hanger includes a flat bottom plate and a flat top plate spaced from the bottom plate, with both plates extending perpendicular to the pendent rail hanger and parallel to the mounting plate.

3. The ceiling mounting bracket of claim 2 wherein the flat top and bottom plates include rail segment receiving means for suspending successive segments of rail.

4. The ceiling mounting bracket of claim 1 wherein the rail hanger is pendent from the central portion of the ceiling bracket bar whereby the movement of the rail hanger is constrained between the ceiling bracket bar retaining means during the adjustable, longitudinal movement of the ceiling bracket bar.

5. The ceiling mounting bracket of claim 1 wherein the ceiling mounting plate includes at least one pair of opposed sidewalls fixed to and depending from the mounting plate and which support the ceiling bracket bar beneath the mounting plate.

6. The ceiling mounting bracket of claim 5 wherein each sidewall has a centrally located aperture and the aperture of one sidewall is in axial alignment with the aperture of the opposed sidewall.

7. The ceiling mounting bracket of claim 1 wherein the length of the ceiling bracket bar is greater than the length of the mounting plate so that the ceiling bracket bar can extend through and past each aperture of each respective sidewall during longitudinal movement thereof.

8. The ceiling mounting bracket of claim 7 wherein a substantial portion of the ceiling bracket bar can project past either sidewall as a result of the longitudinal movement and positioning of the ceiling bracket bar with respect to the mounting plate.

9. The ceiling mounting bracket of claim 1 further comprising a plurality of rail hanger extensions, each having an upper end for attachment to the ceiling bracket bar and a lower end for attachment to the rail hanger.

10. The ceiling mounting bracket of claim 9 wherein the rail hanger extensions come in different lengths so that the use of each respective rail hanger extension causes the respective rail hanger to be suspended at greater distances from the mounting plate and the mine tunnel ceiling.

11. The ceiling mounting bracket of claim 1 wherein the lateral adjustment means includes a pair of opposed lateral adjustment slots integral with the flat mounting plate and perpendicular to the longitudinal slot.

* * * * *